US009228413B2

(12) United States Patent
Fripp et al.

(10) Patent No.: US 9,228,413 B2
(45) Date of Patent: Jan. 5, 2016

(54) MULTI-STAGE SETTING TOOL WITH CONTROLLED FORCE-TIME PROFILE

(71) Applicant: HALLIBURTON ENERGY SERVICES, INC., Houston, TX (US)

(72) Inventors: Michael Linley Fripp, Carrollton, TX (US); Don Kyle, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/115,978

(22) PCT Filed: Jan. 18, 2013

(86) PCT No.: PCT/US2013/022276

§ 371 (c)(1),
(2) Date: Jun. 20, 2014

(87) PCT Pub. No.: WO2014/113025

PCT Pub. Date: Jul. 24, 2014

(65) Prior Publication Data

US 2015/0315871 A1 Nov. 5, 2015

(51) Int. Cl.

| | |
|---|---|
| ***E21B 23/04*** | (2006.01) |
| ***E21B 34/10*** | (2006.01) |
| ***E21B 34/06*** | (2006.01) |
| ***E21B 41/00*** | (2006.01) |
| *E21B 34/00* | (2006.01) |

(52) U.S. Cl.

CPC ..... *E21B 34/10* (2013.01); *E21B 34/063* (2013.01); *E21B 41/00* (2013.01); *E21B 2034/002* (2013.01); *E21B 2034/005* (2013.01)

(58) Field of Classification Search

CPC ... E21B 23/04; E21B 33/127; E21B 33/1272; E21B 33/1275; E21B 33/1295; B66F 3/24

USPC ..... 166/381, 382

See application file for complete search history.

(56) References Cited

U.S. PATENT DOCUMENTS

| | | | | |
|---|---|---|---|---|
| 2,836,250 | A * | 5/1958 | Brown | E21B 33/1295 166/134 |
| 2,901,044 | A * | 8/1959 | Arnold | E21B 23/04 166/212 |
| 5,310,012 | A * | 5/1994 | Cendre | E21B 23/04 175/269 |
| 6,202,748 | B1 | 3/2001 | Carisella et al. | |
| 6,253,857 | B1 * | 7/2001 | Gano | E21B 33/1243 166/321 |
| 6,296,052 | B1 | 10/2001 | Sidwell | |
| 7,000,705 | B2 | 2/2006 | Buyers et al. | |

(Continued)

FOREIGN PATENT DOCUMENTS

WO 2011079169 A2 6/2011

*Primary Examiner* — Kenneth L Thompson

(74) *Attorney, Agent, or Firm* — Chamberlain Hrdlicka

(57) ABSTRACT

A multi-stage setting tool actuated by hydrostatic pressure downhole is provided with a selectable force-time profile during setting. A first port opens a first piston chamber to hydrostatic pressure which drives a first piston. A force-transmitting member, attached to the piston, is driven in response to the fluid pressure increase in the chamber. The process is repeated with sequential ports and piston chambers. A settable tool is set in response to the driving of the force-transmitting member by the pistons. The combined stroke distances and forces of the pistons are selected to set the tool. Opening of the ports can occur in response to electrical signal and can be conditional on occurrence of a selected event or condition. Speed of setting can be regulated.

23 Claims, 4 Drawing Sheets

(56) References Cited

U.S. PATENT DOCUMENTS

| | | | | |
|---|---|---|---|---|
| 7,051,810 | B2 | 5/2006 | Clemens et al. | |
| 7,367,397 | B2 | 5/2008 | Clemens et al. | |
| 7,467,661 | B2 | 12/2008 | Gordon et al. | |
| 7,891,432 | B2 | 2/2011 | Assal | |
| 8,171,988 | B2 * | 5/2012 | Hallundbaek | E21B 23/04 166/178 |
| 8,235,103 | B2 | 8/2012 | Wright et al. | |
| 8,322,426 | B2 | 12/2012 | Wright et al. | |
| 2005/0194152 | A1 * | 9/2005 | Campo | E21B 34/14 166/384 |
| 2008/0011471 | A1 | 1/2008 | Hughes et al. | |
| 2008/0017389 | A1 | 1/2008 | Murray | |
| 2010/0175871 | A1 * | 7/2010 | Wright | E21B 41/00 166/244.1 |
| 2011/0073310 | A1 | 3/2011 | Clemens et al. | |
| 2011/0073328 | A1 | 3/2011 | Clemens et al. | |
| 2011/0073329 | A1 | 3/2011 | Clemens et al. | |
| 2011/0168103 | A1 | 7/2011 | Behar | |
| 2011/0174484 | A1 | 7/2011 | Wright et al. | |
| 2011/0174504 | A1 | 7/2011 | Wright et al. | |
| 2011/0297380 | A1 * | 12/2011 | Alberty | E21B 31/113 166/301 |
| 2012/0298379 | A1 * | 11/2012 | Van Riet | E21B 43/105 166/382 |

* cited by examiner

MULTI-STAGE SETTING TOOL WITH CONTROLLED FORCE-TIME PROFILE

FIELD

Methods and apparatus are presented for a setting tool operable using wellbore hydrostatic pressure, and more particularly, to a setting tool having a customizable force-time profile.

BACKGROUND

Without limiting the scope of the present inventions, their background is described with reference to setting tools, downhole force generators and downhole power units and improvements thereto. It is typical in hydrocarbon wells to "set" or actuate downhole tools, such as packers, bridge plugs, high-expansion gauge hangers, straddles, wellhead plugs, cement retainers, through-tubing plugs, etc. Additionally, some of these tools are later "unset" for retrieval. Setting tools are run-in, and in some cases retrieved, using various conveyance methods such as a wireline, slickline, or coiled tubing. The generic name for the running tool which provides the large setting forces required is a setting tool. Several types of setting tool and downhole force generators (DFG) are known in the art, including those operated mechanically, electrically, chemically, explosively, hydraulically, electro-mechanically, etc.

One type of DFG uses electro-mechanical power, where the DFG converts electrical power, typically provided by a battery unit, into mechanical movement, typically rotary or longitudinal movement of a shaft or power rod. One such setting tool is the DPU (trade name) Downhole Power Unit available from Halliburton Energy Services, Inc. Halliburton's DPU provides an even stroke with a force profile that gradually builds over time. However, the DPU requires a large stack of batteries to drive the motor. The power output needed from the batteries limits the maximum operating temperature for the batteries and for the tool. The use of relatively large quantities of lithium batteries, for higher temperature operations, limits the ability to easily transport the DPU and is a significant cost driver.

Additionally, some industry pyrotechnic setting tools, such as the Baker 20 Setting Tool, available from Baker Oil Tools, Inc., utilize a pyrotechnic material to generated pressure. A chamber containing a high pressure gas houses a floating hydraulic piston with an oil filled chamber below. The hydraulic oil is pressured by the expanding gas, providing hydraulic power which performs the setting task. Disadvantages to such pyrotechnic setting tools include compliance with extensive and costly regulations, including special shipping and handling by trained personnel, storage on licensed premises, third party notification when shipping, inspections by official personnel, and routine inspections. Further, The Baker 20 setting tool delivers peak force at the beginning of the stroke with diminishing force afterwards, especially as the gas generated by the pyrotechnic reaction cools.

Hydrostatic setting tools convert ambient hydrostatic pressure in a wellbore into hydraulic force to set the downhole tool. But many prior art hydraulic setting tools suffer from a very quick force-time profile, where the hydrostatic pressure is applied very quickly. The components in the setting tool then move in response at rapid speeds, which can damage sealing elements and break metallic components.

Further disclosure relating to downhole force generators, their operation and construction, can be found in the following, which are each incorporated herein for all purposes: U.S. Pat. No. 7,051,810 to Clemens, filed Sep. 15, 2003; U.S. Pat. No. 7,367,397 to Clemens, filed Jan. 5, 2006; U.S. Pat. No. 7,467,661 to Gordon, filed Jun. 1, 2006; U.S. Pat. No. 7,000,705 to Baker, filed Sep. 3, 2003; U.S. Pat. No. 7,891,432 to Assal, filed Feb. 26, 2008; U.S. Patent Application Publication No. 2011/0168403 to Patel, filed Jan. 7, 2011; U.S. Patent Application Publication Nos. 2011/0073328 to Clemens, filed Sep. 23, 2010; 2011/0073329 to Clemens, filed Sep. 23, 2010; 2011/0073310 to Clemens, filed Sep. 23, 2010; and International Application No. PCT/US2012/51545, to Halliburton Energy Services, Inc., filed Aug. 20, 2012.

It is an object of the invention then, to provide a downhole force generator or setting tool with a relatively low cost. It is a further object of the invention to provide a DFG capable of operation in high temperature environments. It is a further object of the invention to provide a DFG which delivers high force over a long stroke. It is a further object of the invention to provide a DFG having a customizable force-time profile. It is a further object of this invention to provide a setting tool which is not subject to the regulations and restrictions of typical pyrotechnic setting tools. Other objects and benefits will be apparent to those of skill in the art.

SUMMARY

In aspects, the present disclosure provides methods and apparatus for setting a tool positioned in a subterranean wellbore. In one embodiment, a method is presented for providing a multi-stage setting force for setting a downhole tool positioned in a subterranean wellbore. In an exemplary method, a first port is opened to a first piston chamber having a first piston mounted therein for sliding movement. A fluid at hydrostatic pressure, flows into the first pressure chamber through the first port, thereby driving the first piston. A force-transmitting member, attached to the first piston, is driven in response to the fluid pressure increase in the first chamber. These steps complete the first stage of the multi-stage setting. A second port is later opened to a second piston chamber, fluidly isolated from the first piston chamber. A fluid at hydrostatic pressure flows into the second piston chamber through the second port, thereby driving the second piston. A force-transmitting member, in operable arrangement with the second piston member, is driven in response to the fluid pressure increase in the second chamber. Thereby, a settable downhole tool is set in response to the driving of the force-transmitting member. The force-transmitting member is driven a first stroke distance in response to a first stroke force created by flowing fluid into the first chamber and a second stroke distance in response to a second stroke force created by flowing fluid into the second chamber. The combined stroke distances and force are selected to set the downhole tool. The second stage of setting, beginning with actuation of the second openable port, is completed when movement stops in response to the fluid flowing into the second chamber. In a preferred embodiment, the second stage begins only after completion of the first stage. Alternately, the second stage can be timed or selected to begin prior to completion of the first stage. The actuation of the stages can occur in response to an electrical signal from the surface, from a battery powered unit downhole, or other methods known in the art, or upon a signal initiated upon the occurrence of a selected event or condition, such as the position of a tool element. The selectively openable ports are preferably electronic rupture discs and can also be valves or other openable or removable fluid barriers. In a preferred embodiment, the method the speed of setting is controlled or regulated, for example, by use of fluid metering devices such as flow nozzles, orifices, inflow control devices, autonomous inflow control devices, or weep holes. The design is modular and can incorporate the addition of third, fourth, etc., stages.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

The inventions disclosed herein are for multi-stage setting tools using downhole hydraulic power to provide downhole force for setting oilfield tools. The preferred embodiments of the invention provide multiple useful features. The tool is preferably electrically activated, with activation by a signal sent via wireline, wireless telemetry or a timer circuit. Wellbore fluid enters the tool via electronic rupture discs, such as Halliburton's thruster assembly or Halliburton's thermite-based rupture disc. The preferred embodiments provide for multi-stage activation, with multiple ports used to adjust the force-time profile of the tool stroke. For example, two electronic rupture discs (ERDs) are used to control flow through the two ports. The second ERD is delayed, by the use of a fluid flow device (e.g., fluid diode), check valve, or timer-operated ERD, and subsequently activated at a predetermined time, upon a predetermined contingent (pressure, temperature, rod displacement, etc.) as measured by downhole sensors, or by the user.

Figure 1:
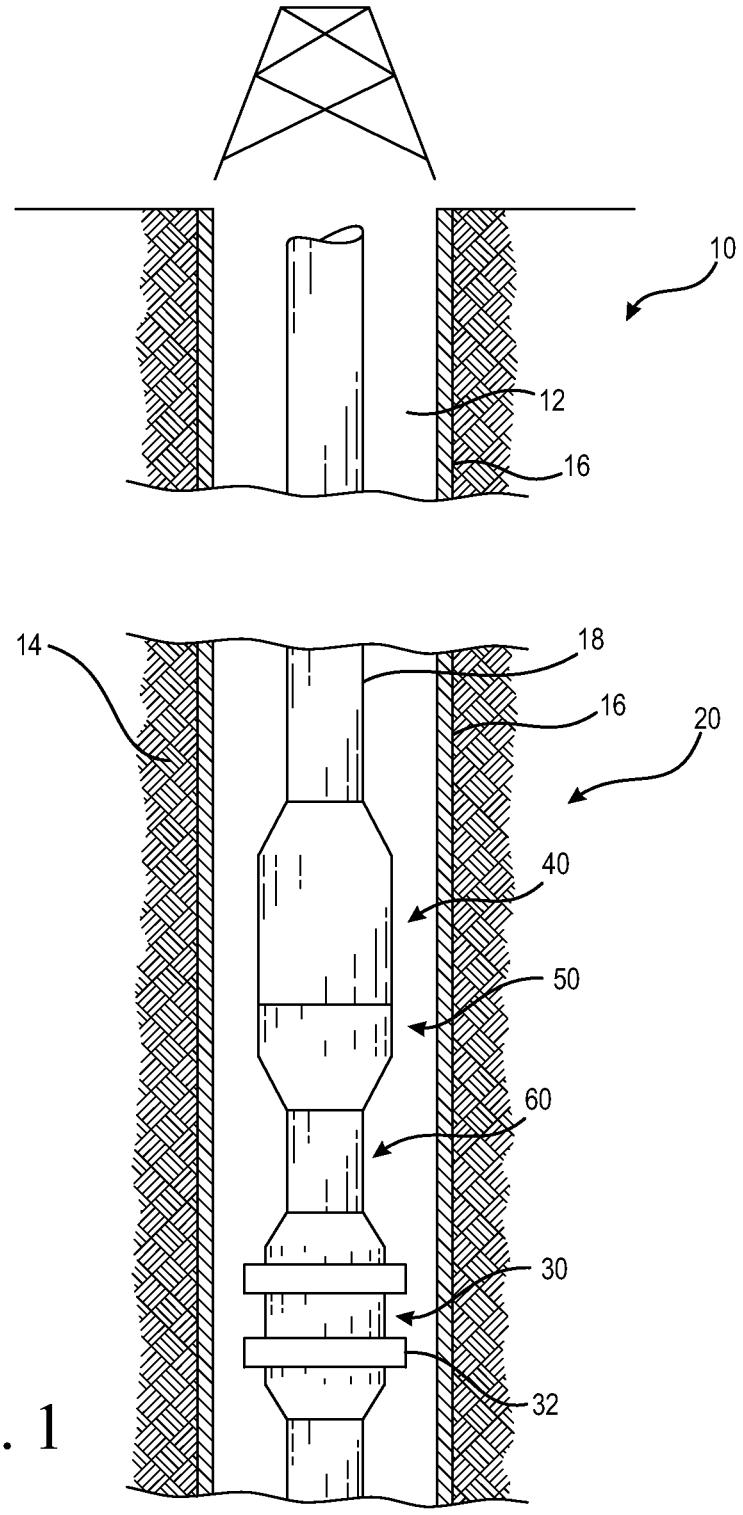
FIG. 1 is a schematic view of a well system including an embodiment of the invention positioned in a subterranean wellbore.

FIG. 1 is a schematic view of a well system including an embodiment of the invention positioned in a subterranean wellbore. A well system 10 is depicted having a wellbore 12 extending through a subterranean formation 14, shown having casing 16. The invention can be used in cased or uncased wells, vertical, deviated or horizontal wells, and for on-shore or off-shore drilling. A tubing string 18 is shown having a plurality of tubing sections 20, a settable downhole tool 30, a downhole force generator (DFG) assembly 40, and a force multiplier assembly 50. A mechanical linkage assembly 60 between the DFG and the downhole tool is provided for transferring the power generated by the DFG into longitudinal or rotary movement, such via a shaft, piston, sleeve, etc. The DFG assembly preferably includes a processor to operate the tool, measure environmental and tool parameters, etc. The settable downhole tools operable by DFG units are not described herein and are well known in the art. For ease of discussion, and by way of example, settable downhole tools such as settable tool 30, shown as a packer, may be utilized in sealing and anchoring the tubing string at a downhole location. The packer has sealing elements 32 which may be set, along with slips, anchors, etc., as is known in the art.

The exemplary setting tools described herein are discussed using general schematics. The details and potential designs, details and specifics are known in the art or will be recognized by one of skill in the art. For disclosure relating to setting tools, see the references incorporated herein.

Figure 2A:
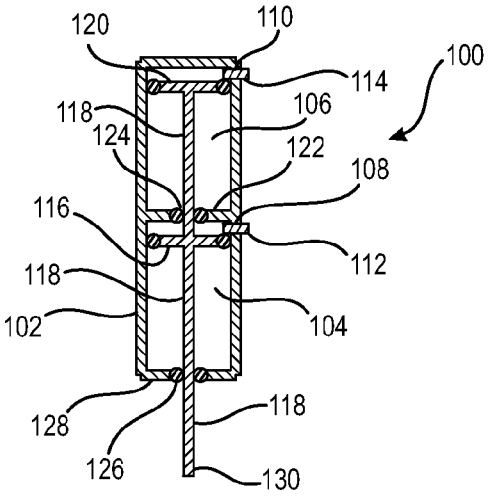
FIGS. 2A-C are schematic views of an exemplary embodiment of a multi-stage setting tool according to an aspect of the invention with FIG. 2A a schematic view of the multi-stage setting tool in an initial or run-in position, FIG. 2B a schematic view of the embodiment of FIG. 2A seen in an intermediate or First Stage position, and FIG. 2C a schematic view of the embodiment of FIGS. 2A-B in a final or Second Stage position.
Figure 2B:
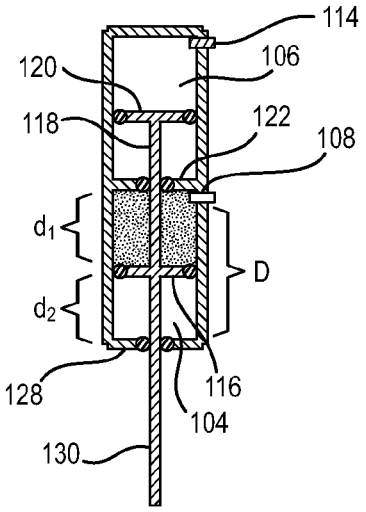
Figure 2C:
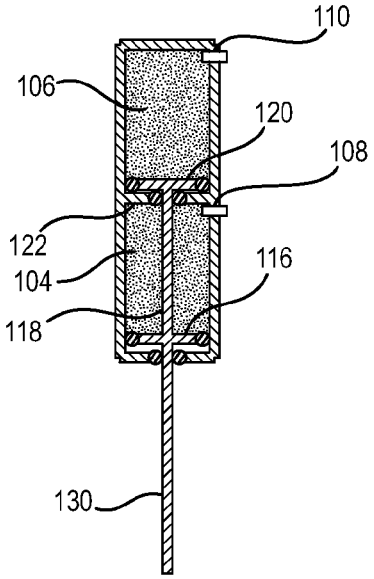

FIGS. 2A-C are schematic views of an exemplary embodiment of a multi-stage setting tool according to an aspect of the invention. FIG. 2A is a schematic view of a multi-stage setting tool in an initial or run-in position. FIG. 2B is a schematic view of the embodiment of FIG. 2A seen in an intermediate or First Stage position. FIG. 2C is a schematic view of the embodiment of FIGS. 2A-B seen in a final or Second Stage position.

The setting tool 100 is seen in an initial or run-in position and generally describing a setting tool housing 102 defining a first interior chamber 104 and a second interior chamber 106. Each chamber has an inlet port, a first and second inlet port 108 and 110, respectively, selectively providing fluid communication between the interior chamber and the annular space defined in the wellbore. Positioned in the first and second ports are a first and second openable or removable fluid barriers, 112 and 114, respectively.

A first piston member 116 is mounted for sliding movement in the first chamber 104 and attached to piston rod 118. A second piston member 120 is mounted for sliding movement in second chamber 106 and attached to the same piston rod 118. The piston members 116 and 120 are shown schematically and can be cylindrical piston heads, annular pistons, piston sleeves, piston mandrels, etc., as are known in the art. The piston rod 118 extends from second piston member 120 in the second chamber 106 into and through the first chamber 104, in which the first piston member is located. In a preferred embodiment, the piston rod extends through a hole 124 through a dividing wall 122 between the first and second chambers. The piston rod further extends beyond the setting tool housing 102 and is attachable to a settable tool. In a preferred embodiment, the piston rod extends through a hole 126 in housing end wall 128. The holes 124 and 126 are sealed about the piston rod and allow reciprocation of the rod. It is understood that the piston rod can be a single length of rod or multiple pieces connected together to form the piston rod, such as by threaded connection, bolted, welded, pin, etc. The free end 130 of the rod is attachable to a settable downhole tool or member thereof, as is known in the art.

The selectively openable ports 108 and 110 are preferably initially blocked by fluid barriers. In a preferred embodiment, the fluid barriers are rupture discs and more specifically electronic rupture discs (ERDs). ERDs and rupture discs are known in the art by those of skill. The discs can be made of plastic, rubber, metal, ceramic, etc., and can be removed or opened by puncturing, rupturing, melting, burning, etc. Further, the discs can be removed or opened by fluid pressure, mechanical contact, application of chemicals, fluid or heat, etc. In a preferred embodiment, ERDs are employed and are actuated by an electrical charge delivered by wire from the surface, from carried batteries, and/or wireless transmission.

In alternative embodiments, the selectively openable ports can be valves, such as, for example, solenoid-driven valves, ball valves, gate valves, and the like, or other mechanisms and methods for blocking fluid passage. Where multiple openable ports are used, various types of openable ports can be employed at various points on the tool. Further, the selectively openable ports can be reciprocating, that is, able to be opened and closed, or simply openable, that is, once opened the port cannot be closed until retrieved to the surface.

The ERD can be an electrically powered mechanical mechanism, such as the thruster or "pin pusher" assembly or, alternately, thermite-based rupture discs, as disclosed in U.S. Patent Application Publication No. 2011/0174504, to Wright, filed Feb. 15, 2010; U.S. Patent Application Publication No. 2011/0174484, to Wright, filed Dec. 11, 2010; U.S. Pat. No. 8,235,103, to Wright, issued Aug. 7, 2012; and U.S. Pat. No. 8,322,426, to Wright, issued Dec. 4, 2012; all of which are incorporated herein by reference for all purposes. One advantage of these ERDs, on which Halliburton Energy Services, Inc., has patents pending, is they take very low electrical power for activation. This allows for low rate batteries, which enables using higher temperature batteries. Halliburton's ERDs can also operate at extremely high temperature. The thruster assembly can operate to 200 C and the thermite-based rupture disc can operate at even hotter temperatures. When coupled with high-temperature electronics, the result is a setting tool that can operate at extreme temperatures. Further, the thruster assembly has been declared "unrated" by the Bureau of Alcohol, Tobacco and Firearms (BATF) and the Department of Transportation (DOT), enabling easier transport and storage. The thermite-based ERD has a relatively low rating compared to some industry standard tools.

In use, in the preferred embodiment, the multi-stage hydraulic-powered setting tool is fired in stages. As shown in FIGS. 2A-C, the first and second fluid barriers are opened or removed in sequence. The method will be discussed for a tool utilizing ERDs as fluid barriers. When the first fluid barrier or ERD 112 is actuated, wellbore fluid enters the first chamber 104. The chamber 104 is initially at a lower pressure than the wellbore pressure, preferably at atmospheric pressure, and sealed closed at the surface. As the environmental temperature heats the tool and gas in the chamber, the pressure will rise. Consequently, the pressure in the chamber at the time of actuation will be somewhat greater than atmospheric pressure. As used herein, the term "near atmospheric" and similar includes these elevated pressures due to environmental effects. Wellbore fluid enters the first chamber through first port 108. The pressure differential across the lower piston member 116 forces the piston member and attached piston rod 118 downward. Second piston member 120 is also moved downward. The piston members and rod move to a First Stage position, as seen in FIG. 2B. Note that the fluid pressure in the second chamber 106 below piston member 120 is raised in response to downward movement of the piston rod. The wellbore fluid, at higher pressure than the fluid in chamber 104, drives the piston members and rod downward until the fluid pressure above the piston member 116, that is, between the piston member 116 and the divider wall 122, equalizes with the pressure of the now-compressed fluid in chamber 104 below the piston member 116, that is, between the piston member 116 and the end wall 128, in combination with the now-compressed fluid in chamber 106 below piston member 120, that is, between piston member 120 and divider wall 122. Stated another way, the force downward on the piston member 116 due to the hydrostatic pressure of the wellbore fluid must be equalized by the combined upward forces from the (now-compressed) chamber fluids below piston members 116 and 120. When the forces equalize, the piston members will stop downward movement. Note that the piston members and rod are moved a first stroke distance, d1, to a First Stage or intermediate position, seen in FIG. 2B, and not moved the full stroke distance, D.

At a later time, the second ERD 114 is activated and wellbore fluid enters the second chamber 106 above the second piston member 120. The second chamber (like the first) is initially filled with a compressible fluid, such as air, nitrogen, a noble gas, or steam, and is at a lower pressure, such as near atmospheric pressure, than the wellbore fluid. Wellbore fluid enters the first chamber through second port 110. The pressure differential across the second piston member 120 drives the piston member 120, thereby moving the piston rod (and first piston member 116) further downward, by a second stroke distance, d2, to a Second Stage or final position, as seen in FIG. 2C. Note that there is now more than twice the force driving the piston rod downward. The force more than doubles since the area on the first piston member is partially occluded by the piston rod. The wellbore fluid, at higher pressure than the fluid in chamber 104, drives the piston members and rod downward until the combined fluid pressure above the first and second piston members 116 and 120 equalizes with the combined pressure of the now-compressed fluids in chambers 104 and 106 below the piston members 116 and 120. That is, the total downward forces on the piston members 116 and 120 must be equalized by the total upward forces above the piston members. The piston rod and heads are moved to a Second Stage or final position, seen in FIG. 2C, and moved the total stroke length, D, of the assembly. It is also possible that the piston members and rod cease movement when mechanically stopped, such as by the piston member 116 contacting a chamber delimiter.

In the preferred embodiment, the first and second ERD 112 and 114 are connected to the wellbore fluid and the wellbore fluid enters the chambers 104 and 106. In an alternative embodiment, the first and second ERD 112 and 114 are connected to a third fluid-filled chamber that is exposed to hydrostatic pressure. Preferably, the third chamber is filled with a clean fluid. The use of a clean fluid ensures that the openings created by the ERD 112 and 114 or the openings in a fluid restrictor (see restrictor 132 in FIG. 4) are not blocked by particles present in the wellbore fluid. The clean fluids in the third chamber are pressurized with hydrostatic pressure by using either a moving piston, a moving baffle, a flexure, or other pressure equalizing device. In alternative embodiments, screens and filters prevent or limit incursion of debris.

Figure 3:
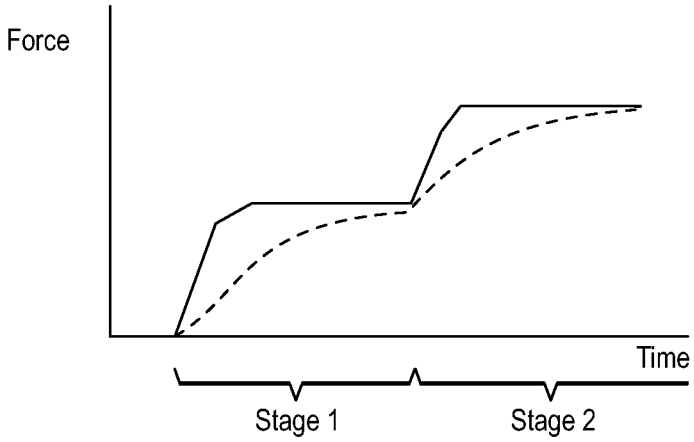
FIG. 3 is a graphical representation of the force-time profile for the setting tool described in FIGS. 2A-C.

FIG. 3 is a graphical representation of the force-time profile for the setting tool described in FIGS. 2A-C. The force in view is the drive-force generated by piston rod or drive rod or shaft 118 for actuating a downhole tool. The result of having separate actuation of the first and second fluid barriers 112 and 114 is to create a unique force-time profile for the setting tool. The firing of the second barrier 114 can be delayed by a predetermined time, a time period adapted to the downhole situation, a time contingent upon another event (such as, for example, measured displacement of the drive rod, estimated velocity of the drive rod, or a temperature corresponding to the temperature of the compressed fluid in chamber 104), or by manual control. The force-time profile can be selected by design parameters of the piston assembly, pressure chambers, and use of flow restrictors, as explained below. As can be seen in FIG. 3, the solid line indicates the force-time profile without use of flow restrictors and the dashed line indicated the profile when restrictors are used. The multi-stage aspect of the tool is designated by Stage identifiers, where the First Stage begins with the opening of the first fluid barrier and the Second Stage begins with opening of the second fluid barrier. The use of a multi-stage setting tool allows for a comparatively larger setting force over the setting force generated by a single-stage tool. This relative increase in available force allows for hydrostatically setting higher-force tools even at shallower depths or lower wellbore pressures. The use of a multi-stage setting tool tends to flatten or smooth the force-time profile when compared to single stage tools. The addition of restrictors tends to further smooth the force-time profile and results in a force that gradually builds over a longer period of time when compared to a similar system without restrictors.

Figure 4:
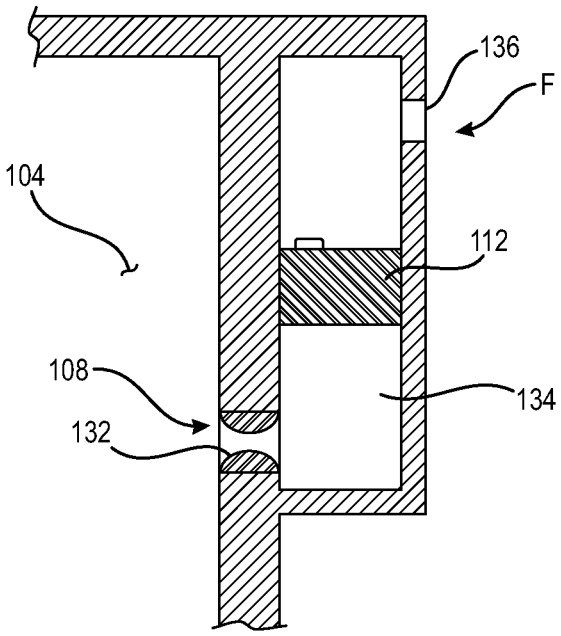
FIG. 4 is a schematic detail of a preferred embodiment according to an aspect of the invention, and having an inflow control device for controlling fluid ingress to the tool chambers.

FIG. 4 is a schematic detail of a preferred embodiment according to an aspect of the invention, and having an inflow control device for controlling fluid ingress to the tool chambers. Preferably, there is a flow restrictor 132 positioned along the flow path from the wellbore to the first chamber 104. An exemplary embodiment, seen in FIG. 4, has a flow restrictor 132 mounted across a fluid passageway 134 (shown positioned in port 108) between the fluid barrier 112 and the first chamber 104. The fluid passageway extends from a wellbore port 136 and inlet port 104. The flow restrictor regulates fluid flow rate from the wellbore to the chamber. Consequently, the flow restrictor slows down how quickly the wellbore fluid pushes on the piston. The flow restrictor can be a flow nozzle, orifice, an inflow control device (ICD), autonomous inflow control device (AICD), a fluidic diode, weep holes, etc., as are known in the art. In a preferred embodiment, a device similar to a fluidic diode can be used. This device slows the fluid entering the device and lengthens the time it takes for the force to build. Preferably a flow restrictor is also positioned to control fluid flow into the second chamber 106.

Figure 5A:
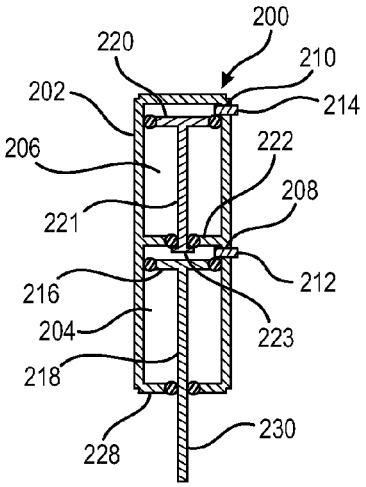
FIGS. 5A-C are schematic views of an alternative exemplary embodiment of a multi-stage setting tool according to an aspect of the invention with FIG. 5A a schematic view of a multi-stage setting tool in a run-in position, FIG. 5B a schematic view of the embodiment of FIG. 5A seen in an intermediate position, and FIG. 5C a schematic view of the embodiment of FIGS. 5A-B seen in a final position.
Figure 5B:
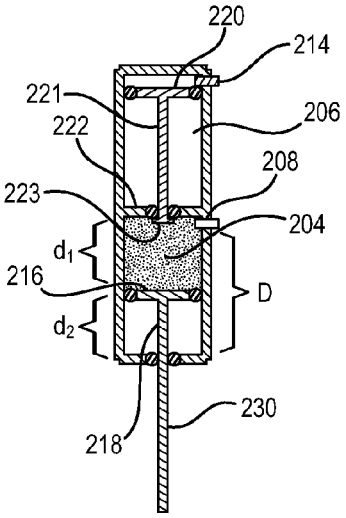
Figure 5C:
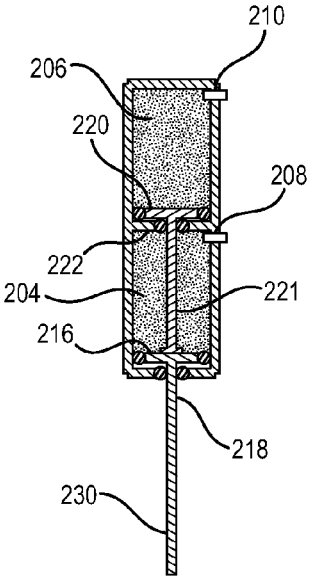

FIGS. 5A-C are schematic views of an alternative exemplary embodiment of a multi-stage setting tool according to an aspect of the invention. FIG. 5A is a schematic view of a multi-stage setting tool in an initial or run-in position. FIG. 5B is a schematic view of the embodiment of FIG. 5A seen in an intermediate or First Stage position. FIG. 5C is a schematic view of the embodiment of FIGS. 5A-B seen in a final or Second Stage position. To the extent that the alternative embodiment is similar to the embodiments explained elsewhere herein, certain details will be understood by practitioners of skill in the art and not described again with reference to FIGS. 5A-C.

The setting tool 200 is seen in an initial or run-in position and generally describing a setting tool housing 202 defining a first interior chamber 204 in selective fluid communication with the wellbore fluid through a first inlet port 208, and a second interior chamber 206 in selective fluid communication with the wellbore fluid through a second inlet port 210. Positioned in the first and second ports are a first and second openable or removable fluid barriers, 212 and 214, respectively.

In the alternative embodiment, the piston rod is constructed in multiple segments. A first piston member 216 is mounted for sliding movement in the first chamber 204 and attached to a first piston rod 218. The first piston rod 218 extends from first piston member 218 through the first chamber 204, in which the first piston member is located, and extends through a hole in end wall 228. The piston rod further extends beyond the setting tool housing 102 and the free end 230 is attachable to a downhole settable tool.

A second piston member 220 is mounted for sliding movement in second chamber 206 and attached to a second piston rod 221. Second piston rod 221 is attached to second piston member 220 and extends from the piston member downward through the second chamber 206, in which the piston member 220 is slidably mounted, and through a hole 224 in dividing wall 222.

The selectively openable ports 208 and 210 are initially blocked by fluid barriers 212 and 214. In a preferred embodiment, the fluid barriers are ERDs, as explained above. More specifically, the preferred ERD is a thruster or pin pusher assembly.

In use, the multi-stage hydraulic-powered setting tool is fired in stages. As shown in FIGS. 5A-C, the first and second fluid barriers are opened or removed in sequence. When the first ERD 212 is actuated, high pressure wellbore fluid enters the first chamber 204, which is at a lower pressure, preferably near atmospheric pressure. The pressure differential across the lower piston member 216 forces the piston member and attached piston rod 218 downward. Second piston member 220 and attached second piston rod 221 remain stationary. The first piston member and rod move to a First Stage position, as seen in FIG. 5B. Note that the first piston member 216 and rod 218 are moved a first stroke distance, d1, to a First Stage or intermediate position, seen in FIG. 5B. Note that hydrostatic pressure will also act with an upward force on the second piston rod 221 at its free end 223.

At a later time, the second ERD 214 is activated and high pressure wellbore fluid enters the second chamber 206 above the second piston member 220. Wellbore fluid enters the second chamber through second port 210. The pressure differential across the second piston member 220 drives the second piston member 221 and second piston rod 221 downward, the rod sliding through a hole in the divider wall 222. The free end 223 of the second piston rod 221 (or a contact element affixed thereto) is moved downward and into contact with the first piston member or rod. The second piston assembly adds its driving force to the first piston assembly, thereby moving the first piston member and rod further downward by a second stroke distance, d2, to a Second Stage or final position, as seen in FIG. 5C. The total stroke distance, D, is the combined first and second stroke distances, d1 and d2. Although the pistons are shown as being the same diameter, different diameter pistons could be used to create different forces for each stage.

Figure 6A:
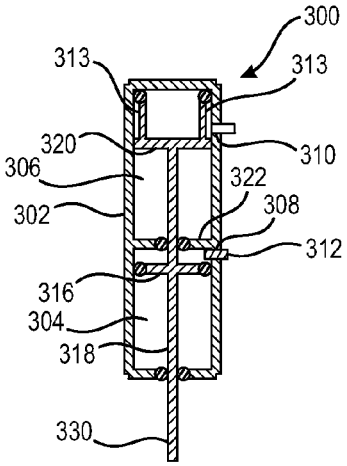
FIGS. 6A-C are schematic views of an alternative exemplary embodiment of a multi-stage setting tool according to an aspect of the invention with FIG. 6A a schematic view of a multi-stage setting tool in a run-in position, FIG. 6B a schematic view of the embodiment of FIG. 6A seen in an intermediate position, and FIG. 6C a schematic view of the embodiment of FIGS. 6A-B seen in a final position.
Figure 6B:
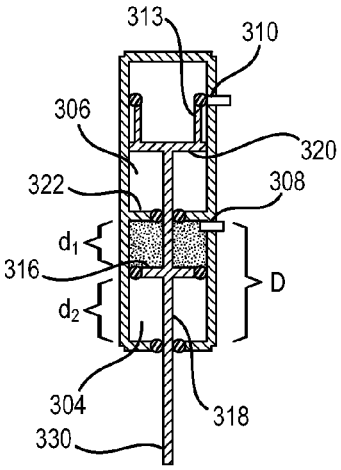
Figure 6C:
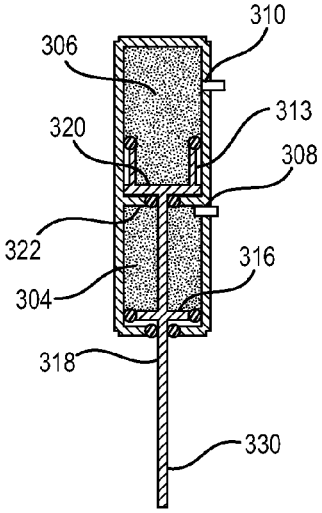

FIGS. 6A-C are schematic views of an alternative exemplary embodiment of a multi-stage setting tool according to an aspect of the invention. FIG. 6A is a schematic view of a multi-stage setting tool in an initial or run-in position. FIG. 6B is a schematic view of the embodiment of FIG. 6A seen in an intermediate or First Stage position. FIG. 6C is a schematic view of the embodiment of FIGS. 6A-B seen in a final or Second Stage position. To the extent that the alternative embodiment is similar to the embodiments explained elsewhere herein, certain details will be understood by practitioners of skill in the art and not described again with reference to FIGS. 6A-C.

The setting tool 300 is seen in an initial or run-in position and generally describing a setting tool housing 302 defining a first interior chamber 304 in selective fluid communication with the wellbore fluid through a first inlet port 308, and a second interior chamber 306 in fluid communication with the wellbore fluid through a second inlet port 310. Positioned in the first port is a first openable or removable fluid barrier 312.

In this embodiment, the system is designed such that a single selectively actuable fluid barrier 312, preferably an ERD, is needed for activation of the assembly. Sliding elements or sleeves 313 prevent the open port 310 from transmitting wellbore pressure to the upper piston during run-in and until the fluid barrier 312 is opened or removed. The sleeves 313 are attached to the second piston member 320 such that movement of the head results in movement of the sleeve. The sleeve 313 is initially positioned blocking the second port 310, preventing inflow of wellbore fluid to the second chamber 306.

After the fluid barrier 312 is actuated (opened or removed), wellbore fluid enters first chamber 304 above first piston member 316, driving the piston rod 318 downward. When the piston assembly strokes far enough that sleeve 313 uncovers the second port 310, wellbore fluid enters the second chamber 306 and provides additional force, provided by hydrostatic pressure acting on second piston member 320, for stroking the piston rod 318. The piston rod is constructed as a single segment extending through both chambers and having a free end 330 below the tool assembly and attachable to a downhole settable tool. The piston assemblies can take various arrangements, including those described elsewhere herein.

The selectively openable port 308 is initially blocked by a fluid barrier 312. In a preferred embodiment, the fluid barrier is an ERD, as explained above. More specifically, the preferred ERD is a thruster or pin pusher assembly.

In use, the multi-stage hydraulic-powered setting tool is fired in stages. As shown in FIGS. 6A-C, the first fluid barrier is opened or removed. High pressure wellbore fluid enters the first chamber 304, which is initially at a lower pressure, preferably near atmospheric pressure. The pressure differential across the lower piston member 316 forces the piston member and attached piston rod 318 downward a first distance, d1. Force is kept relatively low during this portion of piston stroke. Second piston member 320 and attached sleeve 313 are also moved downward as they are attached to piston rod 318. The piston members, rod, and sleeve, are moved to a First Stage position, as seen in FIG. 6B. As the sleeve 313 is moved downward, it eventually uncovers port 310 and high pressure wellbore fluid enters the second chamber 306 above the second piston member 320. The pressure differential across the second piston member 320 drives the second piston member 321 and attached piston rod 318 downward a second stroke distance, d2. The piston rod 318 and its free end 330 moves a total stroke distance, D. The second piston assembly adds its driving force to the first piston assembly, thereby moving the piston rod further downward to a Second Stage or final position, as seen in FIG. 6C. In a preferred embodiment, the second chamber 306 has a greater volume than first chamber 304 to accommodate the sliding elements or sleeves 313. The additional volume slows the filling of the second chamber 304, lengthening the time of the force stroke.

It is understood that the schematic views of the various piston assemblies are not limiting. Alternative piston assemblies will be apparent to those of skill in the art. For example, annular pistons and rods can be employed where it is desired to leave a central passageway through the tool assembly. Further, it is understood that three or more piston assemblies in like number of chambers can be utilized to provide additional setting force and additional setting Stages. That is, the multiple stage assemblies disclosed herein are modular and can be stacked or used in series or parallel to provide additional setting force and/or to elongate setting time.

Further, it is understood that design of the elements of the tool assembly can be selected to provide a customized force-time profile. The dimensions of the piston members, rods, and chambers can be selected. The volume, initial pressures and entrapped fluid of the chambers can be selected. The first, second, and total stroke distances can be selected. Further, the timing of the Second Stage (or further later Stages) can be timed with regard to the beginning, completion, or intermediate point of the First Stage (or other prior Stage). For example, the Second Stage can be actuated upon: cessation of movement due to the First Stage, during movement of the First Stage, upon movement of a selected stroke distance of the First Stage, upon completion of the complete stroke distance achievable by the First Stage, etc. Stated another way, later stages can be timed in relation to prior stages to supply a smoother force-time profile.

A person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A setting tool assembly for providing setting force to a settable downhole tool positioned in a subterranean wellbore, the setting tool assembly comprising:

a housing defining a first pressure chamber and second pressure chamber, the pressure chambers fluidly isolated from one another within the housing;

a first piston member slidingly mounted in the first pressure chamber and a second piston member slidingly mounted in the second pressure chamber;

a first selectively openable port positioned between the first pressure chamber and a hydrostatic fluid, wherein the first piston member is movable in response to the hydrostatic fluid upon opening of the first selectively openable port;

a second selectively openable port positioned between the second pressure chamber and a hydrostatic fluid, wherein the second piston member is movable in response to the hydrostatic fluid upon opening of the second selectively openable port;

a first force-transmitting member attached to the first piston member, attachable to the settable downhole tool, and operable to exert a first force on the settable downhole tool upon opening of the first selectively openable port; and a second force-transmitting member attached to the second piston member and operable to exert a second force on the first force-transmitting member upon opening of the second selectively openable port, and wherein the combined first and second forces are operable to fully set the settable downhole tool.

2. The assembly of claim 1, wherein the first chamber is initially filled with a compressible fluid.

3. The assembly of claim 1, wherein the first and second force-transmitting members form a single piece, are releasably attached to one another, or are each attached to the first piston member.

4. The assembly of claim 1, wherein the first piston member, upon opening of the first selectively openable port, is operable to transmit a first force to the first force-transmitting member, and wherein the second piston member, upon opening of the second selectively openable port, is operable to transmit a second force to the first force-transmitting member, and wherein the sum of the first and second forces is sufficient to set the settable downhole tool.

5. The assembly of claim 1, further comprising a first fluid metering device positioned to meter hydrostatic fluid entry into the first or second pressure chamber.

6. The assembly of claim 1, further comprising a first temporary fluid barrier positioned across the first selectively openable port and a second temporary fluid barrier positioned across the second selectively openable port.

7. The assembly of claim 6, wherein the temporary fluid barriers include at least one rupture disc.

8. The assembly of claim 6, further comprising a first and second actuation assemblies positioned adjacent to and operable to actuate the first and second temporary fluid barriers, respectively.

9. The assembly of claim 8, wherein electrical power to operate the actuation assemblies is supplied from a battery source carried on the tool assembly, from an electrical line to the surface, or from a wireless power transmission.

10. The assembly of claim 1, wherein the first and second selectively openable ports further comprise selectively openable mechanical valves, ball valves, gate valves, solenoid valves, or flapper valves.

11. The assembly of claim 9, wherein the first and second actuation assemblies are actuable upon receipt of spaced first and second signals, respectively.

12. The assembly of claim 1, wherein the second selectively openable port is initially covered by a port cover, the port cover connected to the first piston member.

13. A method for providing a multi-stage setting force for setting a settable downhole tool positioned in a subterranean wellbore, the method comprising the steps of:

a) selectively opening a first port to a first piston chamber having a first piston mounted therein for sliding movement;

b) flowing a fluid at hydrostatic pressure into the first pressure chamber through the first port, thereby driving the first piston;

c) driving a force-transmitting member attached to the first piston in response to step b);

d) selectively opening a second port to a second piston chamber, the second piston chamber fluidly isolated from the first piston chamber;

e) flowing a fluid at hydrostatic pressure into the second piston chamber through the second port, thereby driving the second piston;

f) driving the force-transmitting member in response to step e); and g) setting the settable downhole tool in response to the driving of the force-transmitting member.

14. The method of claim 13, wherein step c) further comprises the step of driving the force-transmitting member a first stroke distance in response to step b).

15. The method of claim 14, wherein step f) further comprises the step of driving the force-transmitting member a second stroke distance in response to step e).

16. The method of claim 15, wherein the first and second stroke distances, combined, are sufficient to perform step g).

17. The method of claim 15, wherein step d) occurs only after movement of the force-transmitting member the first stroke distance.

18. The method of claim 13, wherein step a) occurs upon an electrical signal from a timer, upon a signal from the surface, or upon a signal initiated only upon the occurrence of a selected event or condition.

19. The method of claim 13, wherein steps a) and d) further comprise rupturing a rupturable disc or opening a valve.

20. The method of claim 13, wherein steps b) and e) further comprise flowing the fluid through fluid metering devices.

21. The method of claim 13, wherein step d) occurs after step a) and before the completion of step c).

22. The method of claim 13, further comprising the steps of: selectively opening additional ports corresponding to additional piston chambers, each having a piston mounted therein for sliding movement; sequentially flowing wellbore fluid at hydrostatic pressure into the additional pressure chambers through the additional ports; and, in response thereto, driving the force-transmitting member additional stroke distances.

23. The method of claim 13, wherein step d) further comprises the step of sliding a port cover from a closed position over the second port to an open position in response to driving the first piston in step b).

* * * * *